US008684488B2

(12) United States Patent
Kyotani

(10) Patent No.: US 8,684,488 B2
(45) Date of Patent: Apr. 1, 2014

(54) LIQUID EJECTING DEVICE

(75) Inventor: Tadao Kyotani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 267 days.

(21) Appl. No.: 13/247,884

(22) Filed: Sep. 28, 2011

(65) Prior Publication Data

US 2012/0075377 A1 Mar. 29, 2012

(30) Foreign Application Priority Data

Sep. 29, 2010 (JP) ..... 2010-219721

(51) Int. Cl.
*B41J 29/38* (2006.01)
*B41J 2/165* (2006.01)
*B41J 2/01* (2006.01)

(52) U.S. Cl.
USPC ..... 347/16; 347/23; 347/101

(58) Field of Classification Search
None
See application file for complete search history.

(56) References Cited

U.S. PATENT DOCUMENTS

| | | | | |
|---|---|---|---|---|
| 5,528,350 | A | 6/1996 | Tanaka et al. | |
| 5,642,145 | A | 6/1997 | Tanaka et al. | |
| 2011/0122188 | A1 * | 5/2011 | Mitsunaga | 347/16 |

FOREIGN PATENT DOCUMENTS

| | | | | |
|---|---|---|---|---|
| JP | 563-120672 | A | 5/1988 | |
| JP | H03-269447 | A | 12/1991 | |
| JP | H07-117894 | A | 5/1995 | |
| JP | 11-291476 | * | 10/1999 | B41J 2/01 |
| JP | 2000-218883 | A | 8/2000 | |
| JP | 2001-129979 | A | 5/2001 | |
| JP | 2004-130719 | A | 4/2004 | |

* cited by examiner

*Primary Examiner* — Geoffrey Mruk
(74) *Attorney, Agent, or Firm* — Baker Botts L.L.P.

(57) ABSTRACT

A liquid ejecting device is provided. The liquid ejecting device includes a conveyer, liquid ejecting heads with nozzles to eject droplets of liquid, an liquid purging unit to purge the liquid out of the nozzles, a detector unit to detect presence of a recording medium, a storage unit to store length of the recording medium, a judging unit to judge whether the recording medium is jammed in a conveyer path, a head identifier unit to identify an overlapping liquid ejecting head assumedly facing the jammed recording medium based on the detected result obtained by the detector unit and the length of the recording medium, and an purge controller unit to control an amount of the liquid to be ejected from the nozzles in the remaining liquid ejecting heads to be smaller than an amount of the liquid to be ejected from the nozzles in the identified overlapping liquid ejecting head.

9 Claims, 7 Drawing Sheets

LETTER-SIZED SHEET

| OUTPUTS SIGNALS FROM SHEET SENSORS | | | MAINTENANCE-OBJECTIVE INKJET HEAD | | | |
|---|---|---|---|---|---|---|
| FRONT -HEAD | REA -HEAD | AT-EXIT | K | M | C | Y |
| OFF | OFF | OFF | N | N | N | N |
| ON | OFF | OFF | Y | Y | Y | Y |
| ON | ON | OFF | Y | Y | Y | Y |
| OFF | ON | OFF | Y | Y | Y | Y |
| OFF | ON | ON | N | N | Y | Y |
| OFF | OFF | ON | N | N | N | N |

FIG. 6

POSTCARD-SIZED SHEET

| OUTPUTS SIGNALS FROM SHEET SENSORS | | | MAINTENANCE-OBJECTIVE INKJET HEAD | | | |
|---|---|---|---|---|---|---|
| FRONT -HEAD | REA -HEAD | AT-EXIT | K | M | C | Y |
| OFF | OFF | OFF | N | N | N | N |
| ON | OFF | OFF | Y | Y | N | N |
| OFF | ON | OFF | N | N | Y | Y |
| OFF | OFF | ON | N | N | N | N |

FIG. 7

LIQUID EJECTING DEVICE

CROSS REFERENCE TO RELATED APPLICATION

This application claims priority from Japanese Patent Applications No. 2010-219721, filed on Sep. 29, 2010, the entire subject matter of which is incorporated herein by reference.

BACKGROUND

1. Technical Field

An aspect of the present invention relates to a liquid ejecting device having a liquid ejecting head.

2. Related Art

In an inkjet printer, when a sheet being conveyed jams in a sheet conveyer path, a part of the crumpled sheet may contact nozzle surfaces of inkjet heads. When nozzles in the nozzle surfaces are touched by the crumpled sheet, menisci of the ink formed in the nozzles may be fractured, and the fracture may undesirably affect ink ejecting ability of the inkjet heads. Therefore, in order to restore the ink ejecting ability, after the crumpled sheet is removed from the sheet conveyer path, a cleaning operation to clear the nozzles may be conducted. More specifically, in the cleaning operation, the inks are ejected from the nozzles, and the nozzle surfaces in the inkjet heads are evenly wiped thereafter. In the cleaning operation, the inks are ejected from the nozzles in all of the inkjet heads indiscriminately regardless of the experience of being touched by the sheet.

SUMMARY

In the cleaning operation, therefore, whilst the nozzles having been touched by the sheet are cleared in the cleaning operation, the ink in the inkjet heads, which were not touched by the sheet, are ejected unnecessarily. In other words, the inks in the untouched inkjet heads are consumed to be wasted.

In view of the above drawback, the present invention is advantageous in that a liquid ejecting device, which can restore the liquid ejecting ability of the nozzles whilst an amount of the consumed liquid is reduced, is provided.

According to an aspect of the present invention, a liquid ejecting device, which is configured to eject droplets of liquid onto a surface of a recording medium to record an image, is provided. The liquid ejecting device includes a conveyer, which is configured to convey the recording medium in a conveyer path along a conveying direction, a plurality of liquid ejecting heads, each of which includes a plurality of nozzles configured to eject the droplets of liquid onto the surface of the recording medium being conveyed by the conveyer, an liquid purging unit, which is configured to purge the liquid out of the nozzles of the plurality of liquid ejecting heads, a detector unit, which is arranged in at least one predetermined position along the conveyer path and configured to detect presence of the recording medium in the conveyer path, a storage unit, which is configured to store information concerning length of the recording medium being conveyed along the conveying direction, a judging unit, which is configured to judge whether the recording medium being conveyed is jammed in the conveyer path based on timing when the presence of the recording medium is detected by the detector unit, a head identifier unit, which is configured to identify an overlapping liquid ejecting head assumedly facing the recording medium jammed in the conveyer path amongst the plurality of liquid ejecting heads, when the judging unit determines that the recording medium is jammed in the conveyer path, based on the detected result obtained by the detector unit and the information concerning the length of the recording medium stored in the storage unit, and a purge controller unit, which is configured to manipulate the liquid purging unit to control an amount of the liquid to be purged from the nozzles in the remaining liquid ejecting heads other than the overlapping liquid ejecting head identified by the head identifier unit to be smaller than an amount of the liquid to be purged from the nozzles in the overlapping liquid ejecting head identified by the head identifier unit.

According to the above-described configuration, when the recording medium is jammed in the conveyer path, and when the liquid ejecting heads are cleaned, the amount of the liquid to be ejected from the nozzles of the liquid ejecting heads which are, assumedly, less likely to have been touched by the jammed recording medium can be maintained to be smaller than an amount of the liquid ejected from the nozzles of all the liquid ejecting heads indiscriminately regardless of the experience of being touched by the recording medium. Therefore, an amount of the inks to be wasted in the cleaning operation can be effectively reduced whilst the liquid ejecting ability of the possibly-touched liquid ejecting head is regained.

BRIEF DESCRIPTION OF THE ACCOMPANYING DRAWINGS

FIG. 6 is a chart to illustrate a lookup table for a maintenance-objective head identifier unit in the inkjet printer according to the first embodiment of the present invention.

FIG. 7 is another chart to illustrate a lookup table for the maintenance-objective head identifier unit in the inkjet printer according to the first embodiment of the present invention.

DETAILED DESCRIPTION

Figure 1:
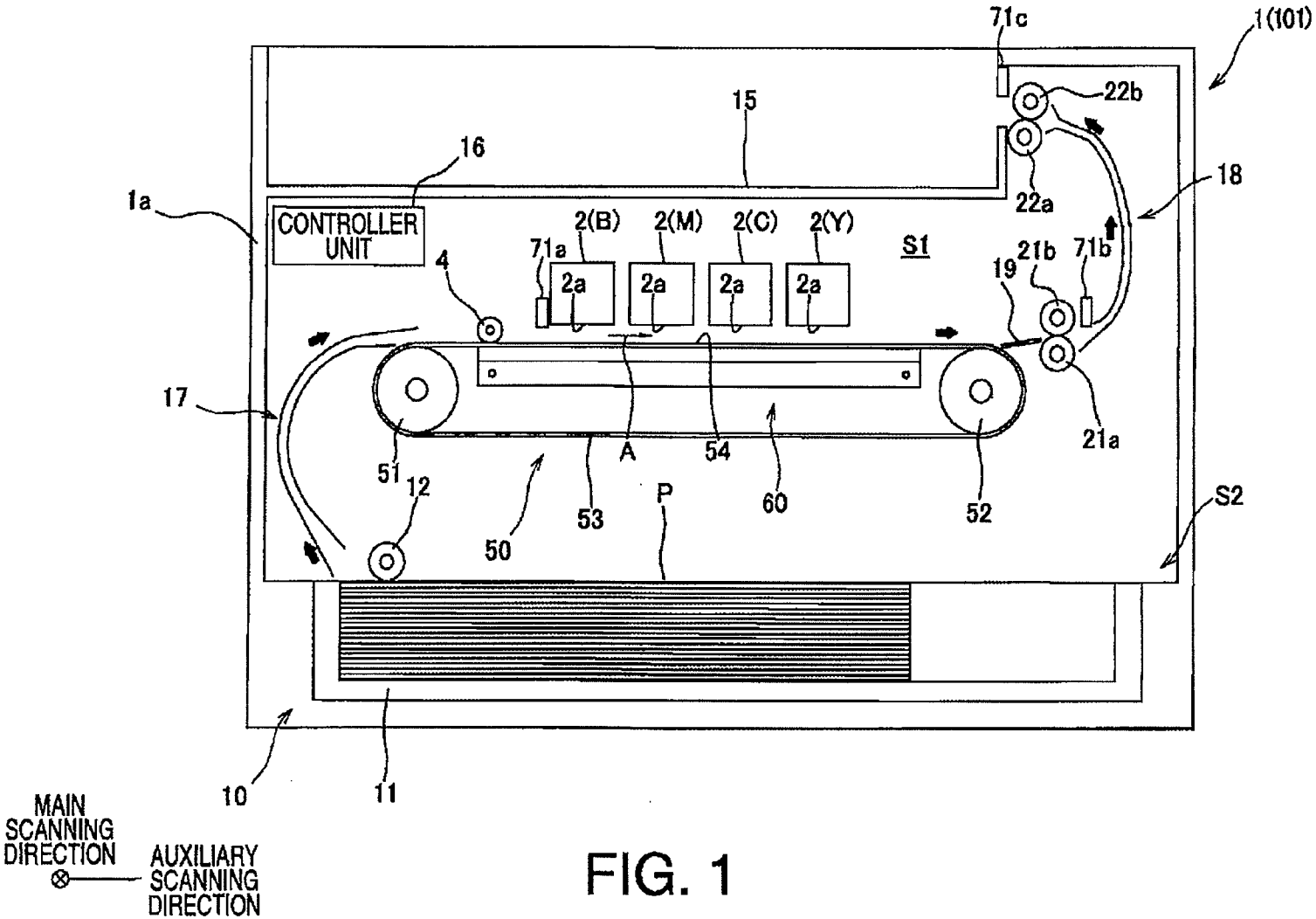
FIG. 1 is a schematic cross-sectional side view of an inkjet printer according to a first embodiment of the present invention.

Hereinafter, embodiments of the present invention will be described with reference to the accompanying drawings.

First Embodiment

An inkjet printer 1 (see FIG. 1) according to the present embodiment includes a box-shaped chassis 1*a*, which has a discharge section 15 in an upper part thereof. Internal space in the chassis 1*a* includes upper space S1 and lower space S2. In the upper space S1, four inkjet heads 2 and a conveyer unit 50 are arranged. Each of the inkjet heads 2 ejects droplets of one of different colored inks, which are, for example, black (K), magenta (M), cyan (C), and yellow (Y). The conveyer unit 50 conveys a sheet P being a recording medium along a sheet-conveying direction. In the lower space S2, a feeder unit 10 to feed the sheet P in a sheet conveyer path is arranged. The inkjet printer 1 further includes a controller unit 16, which controls behaviors of the components in the inkjet printer 1. In the present embodiment, a direction in parallel with the sheet-conveying direction is referred to as an auxiliary scanning direction of the inkjet printer 1, whereas a main scanning direction is a direction orthogonal to the sheet-conveying direction and in parallel with a horizontal plane.

In the inkjet printer 1, the sheet conveyer path, in which the sheet P is carried by the conveyer unit 50, is formed to extend from the feeder unit 10 to the discharge section 15. A flow of the sheet P in the sheet conveyer path is indicated by thick arrows in FIG. 1. The feeder unit 10 includes a sheet cassette 11, in which one or more sheets P can be stored in stack, a feeder roller 12, which picks up one of the sheet P from the sheet cassette 11, and a feeder roller (not shown) to rotate the feeder roller 12.

As the feeder roller 12 is rotated in a predetermined direction, e.g., clockwise in FIG. 1, a topmost sheet P in the stack of sheets P stored in the sheet cassette 11 is picked up to be fed in the sheet conveyer path. Meanwhile, on a left-hand side of the conveyer unit 50 in FIG. 1, a sheet guide 17 is provided. The sheet guide 17 is formed to curve upwardly from the sheet cassette 11 and guides the sheet P there-along. Thus, the sheet P picked up by the feeder roller 12 is forwarded along the sheet guide 17 to an upper outer surface of a conveyer belt 53 in the conveyer unit 50.

Figure 2:
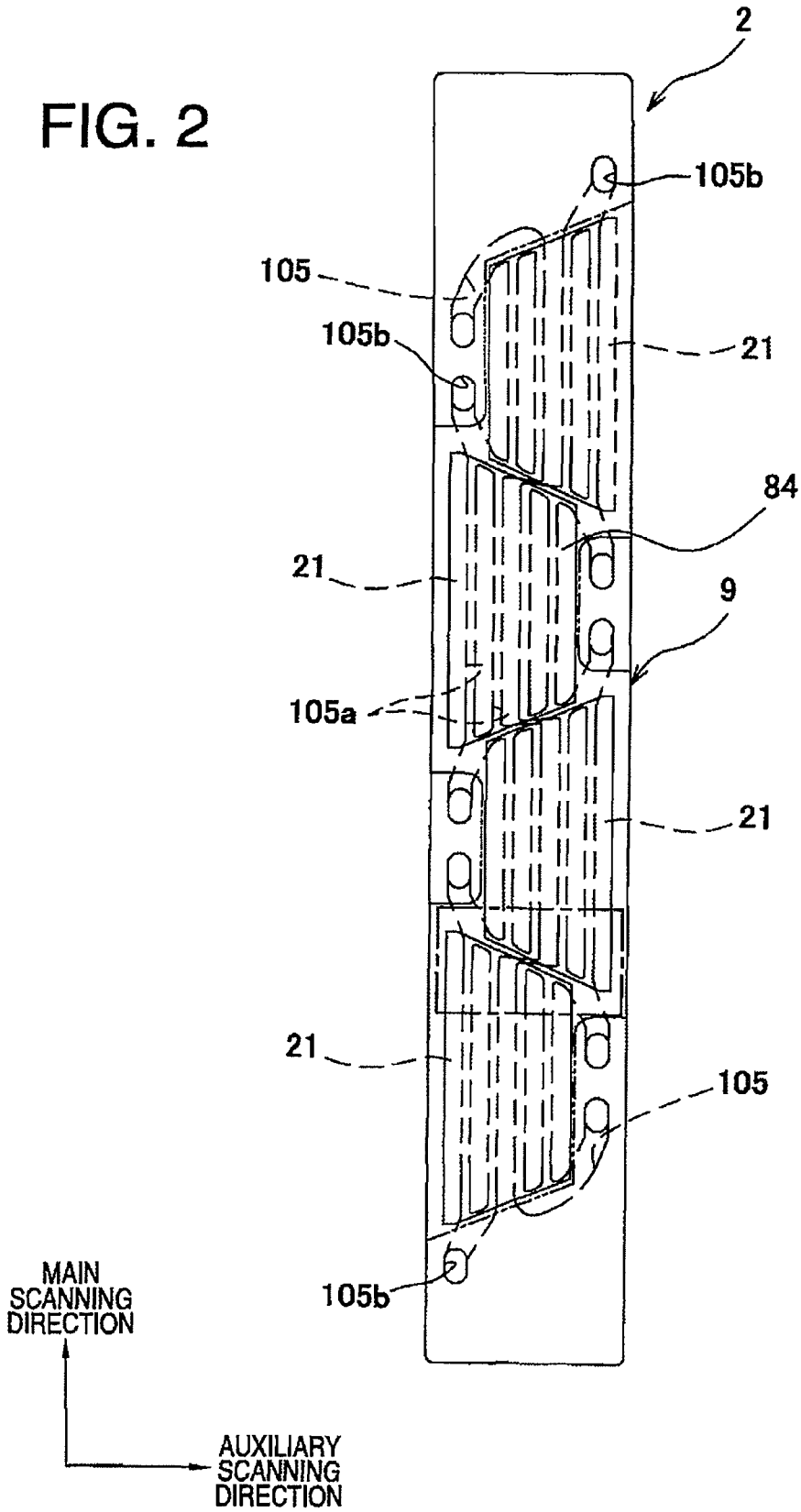
FIG. 2 is a top plane view of an inkjet-head in the inkjet printer according to the first embodiment of the present invention.

The conveyer unit 50 is arranged in a lower opposite position with respect to the four inkjet heads (see FIGS. 1 and 2). The conveyer unit 50 includes a pair of belt rollers 51, 52, an endless conveyer belt 53, which rolls around the belt rollers 51, 52, a conveyer motor (not shown) to rotate the belt roller 52, a platen 60 to hold the sheet P, and a pair of supporting plates (not shown), which supports the belt rollers 51, 52. The belt rollers 51, 52 are arranged in parallel with each other to align orthogonally to the sheet-conveying direction and rotatably supported by the supporting plates via shafts (not shown). The upper outer surface of the conveyer belt 53 includes a flushing area (not shown), which extends along a widthwise direction (i.e., in parallel with the main scanning direction) of the conveyer belt 53. In the flushing area, ink droplets are ejected from the inkjet heads 2 in a maintenance operation, which will be described later in detail.

The platen 60 holds a lower side of the sheet P via the conveyer belt 53. In an upstream position with respect to the platen 60 along the sheet-conveying direction, and in a position opposite from the platen 60 across a conveyer surface 54 (i.e., an upper portion) of the conveyer belt 53, a nip roller 4 is arranged. The nip roller 4 applies pressure to the sheet P having been conveyed from the feeder unit 10 toward the conveyer surface 54 of the conveyer belt 53.

When the belt roller 52 rotates in the clockwise direction in FIG. 1, the conveyer belt 53 rolls in the clockwise direction accordingly. In this regard, the belt roller 51 and the nip roller 4 are rotated along with the rolling movement of the conveyer belt 53.

Thus, the sheet P having been conveyed from the feeder unit 10 to the conveyer belt 53 is carried further in the sheet-conveying direction, which is indicated by the thick arrows. When the sheet P is carried to a position directly below one of the inkjet heads 2, the inkjet head 2 ejects the ink in droplets toward the sheet P to form a colored image on the sheet P. As the sheet P is carried further on the conveyer belt 53, droplets of inks in the different colors are overlaid, and an image in different colors is formed on the sheet P.

In a downstream position with respect to the conveyer unit 50 along the sheet-conveying direction, a separator 19 is provided. More specifically, the separator 19 is arranged in a position to be inserted between the sheet P being forwarded beyond the conveyer belt 53 and the conveyer belt 53. Thus, when the sheet P proceeds over the separator 19, the separator 19 separates the sheet P from the conveyer surface 54.

In a section between the conveyer unit 50 and the discharge section 15, two pairs of conveyer rollers 21*a*, 21*b* and 22*a*, 22*b* are arranged along the sheet conveyer path. Further, a sheet guide 18, which guides the sheet P from the conveyer rollers 21*a*, 21*b* to the conveyer rollers 22*a*, 22*b*, is provided. The conveyer rollers 21*b*, 22*b* are rotated by a motor (not shown). Meanwhile, the conveyer rollers 21*a*, 22*a* are driven rollers, which are driven according to the rotation of the conveyer rollers 21*b*, 22*b*. When the conveyer rollers 21*b*, 22*b* are rotated with the sheet P nipped between the conveyer rollers 21*a*, 21*b* and/or the conveyer rollers 22*a*, 22*b*, the sheet P having been carried by the conveyer unit 50 is forwarded upwardly to exit from the internal space of the inkjet printer 1 through an exit (unsigned) and settled in the discharge section 15.

Along the sheet conveyer path, the inkjet printer 1 is provided with three sheet sensors 71*a*, 71*b*, 71*c*, which detect presence of the sheet P being conveyed. In particular, in a downstream position with respect to the nip roller 4 and an upstream position with respect to the inkjet heads 2, a front-head sheet sensor 71*a* is provided. Further, along the sheet conveyer path, in a downstream position with respect to the inkjet heads 2 and the conveyer rollers 21*a*, 21*b* and an upstream position with respect to the conveyer rollers 22*a*, 22*b*, a rear-head sheet sensor 7l b is provided. Furthermore, in a downstream position with respect to the conveyer rollers 22*a*, 22*b*, in vicinity of the exit of the sheet conveyer path, an at-exit sheet sensor 71*c* is provided. The sheet sensors 71*a*-71*c* are reflective optical sensors, which indicate ON when the sheet P is in positions below the sheet sensors 71*a*-71*c* and OFF when the sheet P is out of the positions below the sheet sensors 71*a*-71*c*.

Figure 3:
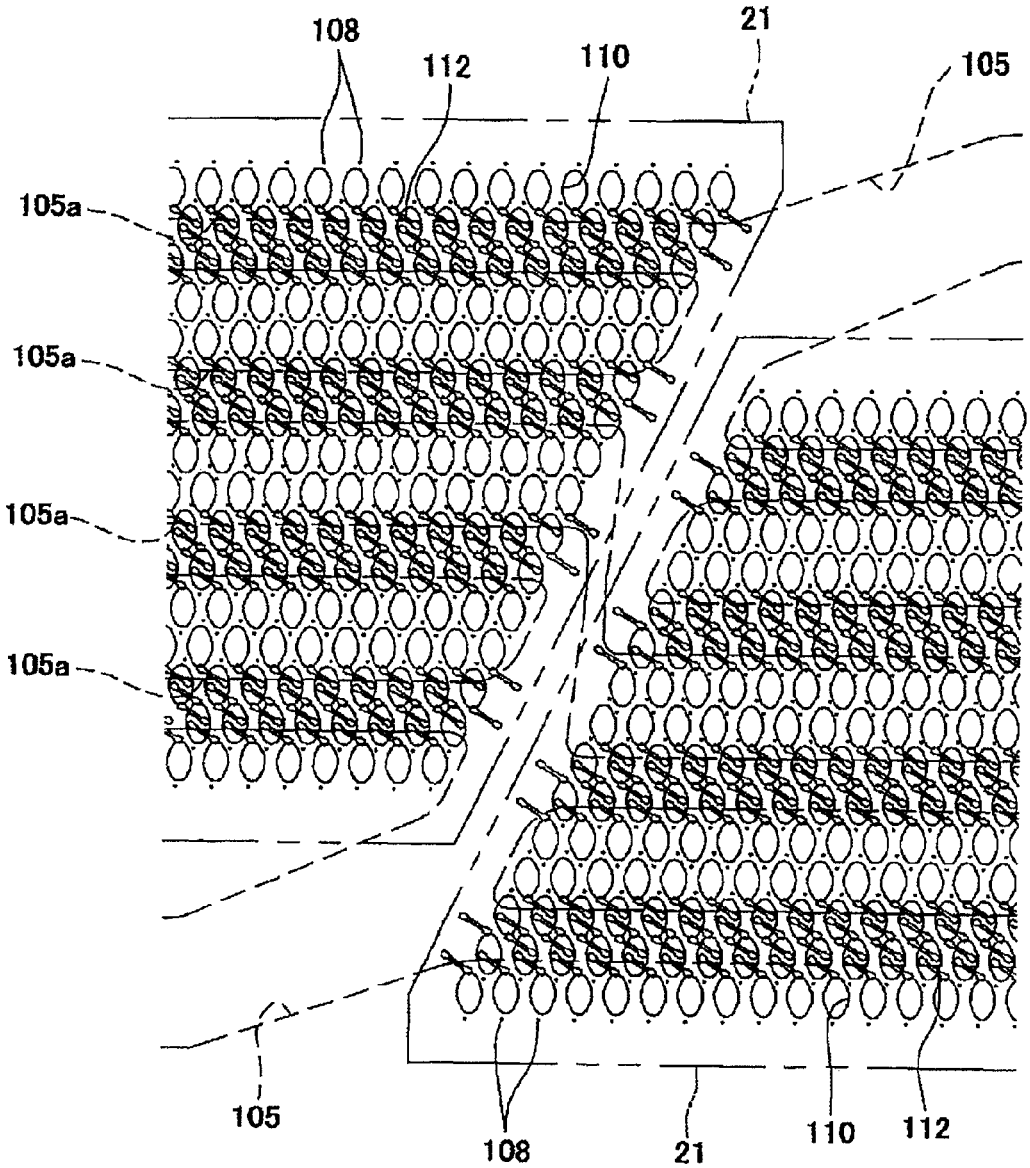
FIG. 3 is an enlarged partial view of an area in the head enclosed by a dotted line shown in FIG. 2.

The inkjet heads 2 will be described hereinbelow with reference to FIGS. 2 and 3. It is to be noted in FIG. 3 that pressure chambers 110, apertures 112, and the nozzles 108, which are in positions lower than actuator units 21 to be drawn in broken lines, are drawn in solid lines for the sake of expedience.

Figure 4:
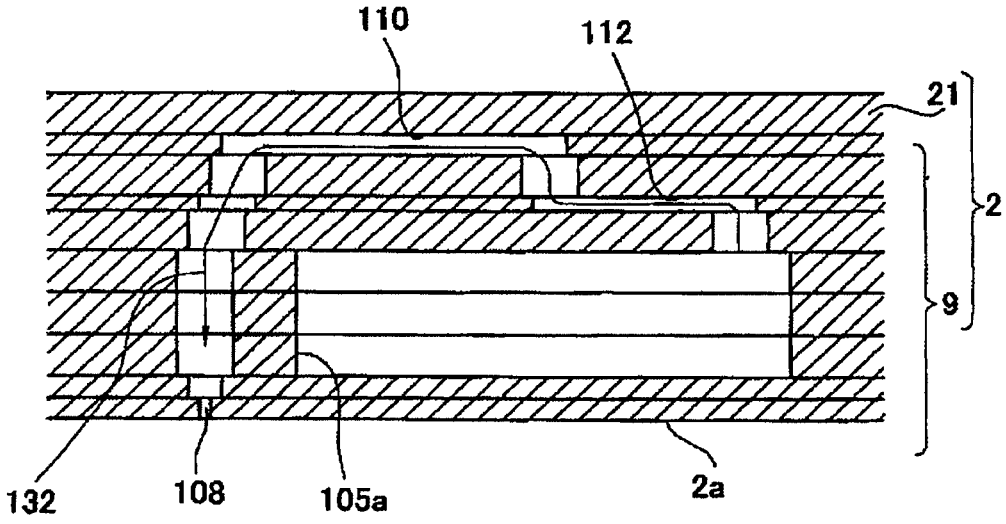
FIG. 4 is a cross-sectional partial view of the head in the inkjet head of the inkjet printer according to the embodiment of the present invention.

Each of the inkjet heads 2 includes a fluid channel unit 9 in a lower section and four actuator units 21 attached on top of the fluid channel unit 9 (see FIG. 4). On a top surface of the fluid channel unit 9, a plurality (e.g., 10) of ink supply holes 105*b*, which are in fluid communication with an ink reservoir (not shown), are formed. In the fluid channel unit 9, manifold channels 105, which are in fluid communication with the ink supply holes 105*b*, and subsidiary manifold channels 105*a*, which are included in the manifold channels 105, are formed. Further, the fluid channel unit 9 is formed to have branched ink channels 132, which diverge from the subsidiary manifold channels 105*a* to be in fluid communication with the nozzles 108 via the pressure chambers 110. On the nozzle surface 2*a*, the nozzles 108 are formed in arrangement of matrix.

The actuator unit 21 includes a plurality of unimorph-typed actuators, each of which is in a position to correspond to one of the pressure chambers 110. The actuators selectively apply pressure to the ink in the pressure chambers 110 to have droplets of the ink ejected by the pressure from the nozzles 108 onto the sheet P.

Flows of the ink in the fluid channel unit 9 will be described below. The ink conveyed to the ink supply holes 105*b* is distributed in the subsidiary manifold channels 105*a* in the manifold channels 105. The ink in the subsidiary manifold channels 105*a* is introduced to the branched ink channels via the apertures 112 and the pressure chambers 110 to be forwarded to the nozzles 108. When the actuator units 21 are activated, pressure is applied to the ink in the pressure chambers 110, and the inks are ejected from the nozzles 108 in droplets by the pressure.

Figure 5:
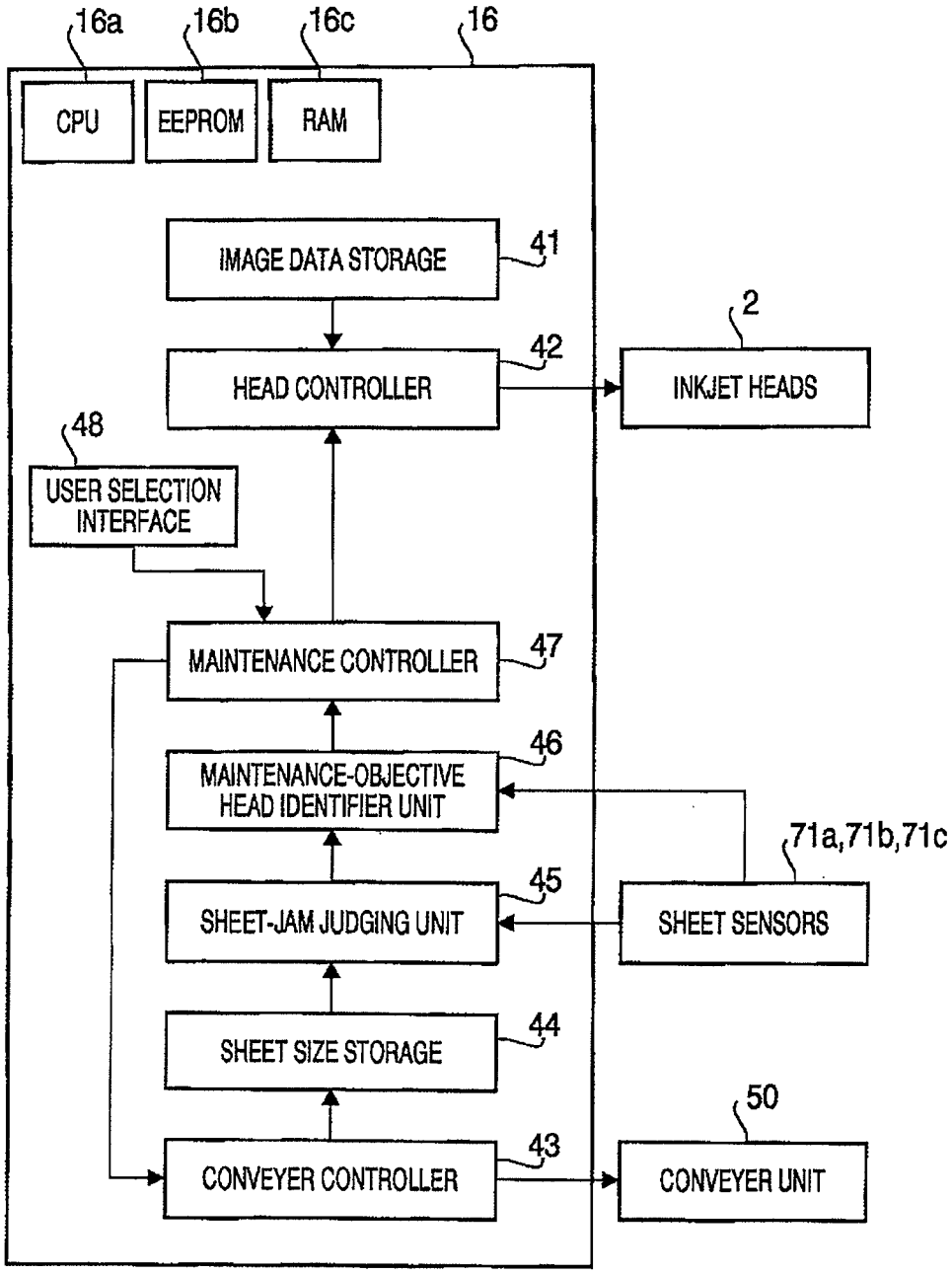
FIG. 5 is a block diagram to illustrate components in a controller unit in the inkjet printer according to the first embodiment of the present invention.

The controller unit 16 will be described below with reference to FIG. 5. The controller unit 16 includes a central processing unit (CPU) 16*a*, an electrically erasable and programmable read only memory (EEPROM) 16*b*, and a random access memory (RAM) 16*c*, which are connected with one another and with each of components in the controller unit 16 described below (conductive lines to indicate the connection are omitted in FIG. 5). The CPU 16*a* executes arithmetic operations, and the EEPROM 16*b* is a rewritable memory to store controlling programs and instructions to be executed by the CPU 16*a* and data to be used in the controlling programs. The RAM 16*c* temporarily stores data to be used in the controlling programs when the programs are active. Thus, the components in the controller unit 16, including the hardware and the software programs stored in the EEPROM 16*b*, work in cooperation with one another to achieve functionality of the inkjet printer 1. The components in the controller unit 16 include an image data storage 41, a head controller 42, a conveyer controller 43, a sheet-size storage 44, a sheet-jam judging unit 45, a maintenance-objective head identifier unit 46, a maintenance controller 47, and a user selection interface unit 48.

The image data storage 41 stores image data, which represents an image to be printed on the sheet P. The head controller 42 manipulates the actuator units 21 of the inkjet heads 2 to control behaviors of the inkjet heads 2 ejecting the inks from the nozzles 108. Therefore, when the image is printed on the sheet P, the head controller 42 manipulates the actuator units 21 according to the image data in order to eject the droplets to form the image on the sheet P. In other words, the image data may be print data, which represents signals to drive the actuator units 21. Alternatively, the image data stored in the image data storage 41 may be converted into the print data representing the signals to drive the actuator units 21.

The conveyer controller 43 controls the conveyer motor (not shown) of the conveyer unit 50 to have the sheet P conveyed in a predetermine speed along the sheet-conveying direction. The sheet-size storage 44 stores information concerning a size of the sheet P to have the image printed and be conveyed by the conveyer controller 43. The sheet size may include a length of the sheet P and a width of the sheet P. According to the present embodiment, a range of the sheet P extending along the sheet-conveying direction is referred to as length, and a range of the sheet P orthogonal to the lengthwise direction is referred to as width. Further, in the present embodiment, options of the sheet size include a letter size and a postcard size. Either one of the options is stored in the sheet-size storage for the sheet size of the image to be formed. The sheet size option is transmitted to the inkjet printer 1 from an external device (e.g., a personal computer) along with the image data and stored in association with the image data in the sheet-size storage 44. Furthermore, it is to be noted that the inkjet printer 1 shown in FIG. 1 includes a single set of the sheet cassette 11 and the feed roller 12. However, the inkjet printer 1 may optionally be equipped with a plurality of sets of the sheet cassette 11 and the feed roller 12, each of which corresponds to one of the sheet size options. In this multiple sheet-size configuration, the sheet P in the selected sheet size is selectively fed in the sheet conveyer path.

The sheet-jam judging unit 45 examines the sheet size stored in the sheet size storage 44 and signals output from the sheet sensors 71*a*-71*c* and judges as to whether the sheet P is stuck (jammed) in the sheet conveyer path. More specifically, the sheet-jam judging unit 45 starts measuring a first time period of predetermined length, which would be required for the sheet P to travel a distance equivalent to the length of the sheet P at the predetermined speed, when the output signals from the sheet sensors 71*a*, 71*b*, 71*c* change from OFF to ON, i.e., when the sheet sensors 71*a*, 71*b*, 71*c* detect the lengthwise-front end of the sheet P. If the output signals from the sheet sensors 71*a*, 71*b*, 71*c* do not change from ON to OFF, i.e., if one of the sheet sensors 71*a*-71*c* fails to detect the lengthwise-rear end of the sheet P within the first time period, the sheet-jam judging unit 45 determines that the sheet P is jammed in the sheet conveyer path. Further, the sheet-jam judging unit 45 starts measuring a second time period of predetermined length, which would be required for the sheet P to travel distances between the sheet sensors 71*a*, 71*b*, and between the sheet sensors 71*b*, 71*c*, when the output signals from the sheet sensors 71*a*, 71*b* change from OFF to ON respectively, i.e., when the sheet sensors 71*a*, 71*b* detect the lengthwise front end of the sheet P. If the output signals from the sheet sensors 71*b*, 71*c* do not change from ON to OFF, i.e., if the sheet sensor 71*b* or 71*c* fails to detect the lengthwise-rear end of the sheet P within the second time period, the sheet-jam judging unit 45 determines that the sheet P is jammed in a position between the sheet sensors 71*a*, 71*b*, and between the sheet sensors 71*b*, 71*c* along the sheet conveyer path. The first time period and the second time period are determined based on the information concerning the sheet size stored in the sheet size storage 44.

The maintenance-objective head identifier unit 46 identifies one or more inkjet heads 2, which can be in positions to assumedly face (and possibly even touched by) the jammed sheet P, when the sheet-jam judging unit 45 determines that the sheet P is jammed, amongst the four inkjet heads 2 based on the sheet size stored in the sheet size storage 44 and the signals output from the sheet sensors 71*a*-71*c* with reference to one of lookup tables (see FIGS. 6-7) prepared in advance. The lookup tables are stored in a predetermined area in a data storage unit (not shown) in the inkjet printer 1. Information concerning the identified maintenance-objective inkjet head (s) is stored by the maintenance-objective head identifier unit 46 in a predetermined data storage area in a nonvolatile memory (not shown).

The lookup tables indicate correspondence between combinations of the output signals from the sheet sensors 71*a*-71*c* and the inkjet heads 2, which can be in the sheet-touchable positions, on basis of the sheet size. In FIGS. 6-7, the front-head sensor refers to the sheet sensor 71*a*, the rear-head sensor refers to the sheet sensor 71*b*, and the at-exit sensor refers to the sheet sensor 71*c*. In the present embodiment, the length of the letter-sized sheet P along the sheet-conveying direction is longer than a distance between the front-head sheet sensor 71*a* and the rear-head sheet sensor 71*b* but shorter than a distance between the front-head sheet sensor 71*a* and the at-exit sheet sensor 71*c*. The length of the postcard-sized sheet P along the sheet-conveying direction is shorter than the distance between the front-head sheet sensor 71*a* and the rear-head sheet sensor 71*b* and shorter than the distance between the rear-head sheet sensor 71*b* and the at-exit sheet sensor 71*c*.

When the sheet P is a letter-sized sheet P, the lookup table shown in FIG. 6 is referred to. When the signals output from the front-head sheet sensor 71*a* indicate ON, the maintenance-objective head identifier unit 46 identifies the maintenance-objective inkjet heads 2, which vertically overlap to be included in a lengthwise range of the sheet P on a downstream side with respect to the position of the front-head sheet sensor 71*a* along the sheet-conveying direction. In the present example, as indicated by a sign "Y" for "YES" in FIG. 6, all of the four inkjet heads 2 are identified. When the signals from the rear-head sheet sensor 71*b* indicate ON and the signals from the at-exit sheet sensor 71*c* indicate OFF, the maintenance-objective head identifier unit 46 identifies the maintenance-objective inkjet heads 2, which vertically overlap to be included in the lengthwise range of the sheet P on an upstream side with respect to the rear-head sheet sensor 71*b*. In the present example, all of the four inkjet heads 2 are identified. When the signals output from the rear-head sheet sensor 71*b* and the at-exit sheet sensor 17*c* indicate ON, the maintenance-objective head identifier unit 46 identifies the maintenance-objective inkjet heads 2, which vertically overlap to be included in the lengthwise range of the sheet P on a downstream side with respect to the position of the at-exit sheet sensor 71*c* along the sheet-conveying direction. In the present example, the inkjet heads 2 for cyan (C) and yellow (Y) are identified.

When the sheet P is a postcard-sized sheet P (see FIG. 7), and when the signals output from the front-head sheet sensor 71*a* indicate ON, the maintenance-objective head identifier unit 46 identifies the maintenance-objective inkjet heads 2, which vertically overlap to be included in a lengthwise range of the sheet P on a downstream side with respect to the position of the front-head sheet sensor 71*a* along the sheet-conveying direction. In the present example, as indicated by a sign "Y" for "YES" in FIG. 7, the inkjet heads 2 for black (K) and magenta (M) are identified. When the signals from the rear-head sheet sensor 71*b* indicate ON, the maintenance-objective head identifier unit 46 maintenance-objective identifies the inkjet heads 2, which overlap to be included in the lengthwise range of the sheet P on an upstream side with respect to the rear-head sheet sensor 71*b*. In the present example, the inkjet heads 2 for cyan (C) and yellow (Y) are identified.

When the sheet-jam judging unit 45 determines that the sheet P is jammed in the sheet conveyer path, a user is notified of the sheet jam and required to remove the jammed sheet by, for example, a message through a display (not shown) or an alarm lamp (not shown). Removal of the jammed sheet P out of the sheet conveyer path can be recognized by, for example, the user's input through a touch-sensitive panel (not shown) or by a sensor (not shown), which can detect opening and closing motions of a covering (not shown) for the sheet conveyer path. When the maintenance controller 47 determines that the jammed sheet P is removed from the sheet conveyer path, the maintenance controller 47 executes a maintenance operation. In this regard, when the sheet P is jammed, the crumpled sheet P may contact the nozzles 108, and menisci formed in the nozzles 108 may be fractured. Further, the ink of different colors may be mixed into the other ink in the touched nozzles 108 via the jammed sheet P. In other words, the contact with the jammed sheet P may deteriorate the ink ejecting function of the inkjet heads 2. Therefore, in order to clear the nozzle surfaces and restore the fractured menisci of the inks in the nozzles 108, the maintenance operation is executed.

The user selection interface unit 48 is an interface unit, which can display the message to notify the user of the sheet jam when the sheet-jam judging unit 45 determines that the sheet P is jammed and present options to the user as to whether the maintenance operation should be executed. The user can enter one of the two options (conduct or not conduct the maintenance operation) through the user selection interface unit 48. The entered option is transmitted to the maintenance controller 47.

The maintenance controller 47 shifts to a standby state, in which no maintenance operation is conducted, when the user's selection indicates that no maintenance operation should be conducted. When the user's selection indicates that the maintenance operation should be conducted, the maintenance controller 47 starts the maintenance operation to purge the inks out of the identified inkjet heads 2. In this regard, purging can be achieved by ejecting the ink droplets out of the nozzles 108 of the inkjet heads 2. That is, the conveyer controller 43 manipulates the conveyer unit 50 to move the identified inkjet heads 2, identified by the maintenance-objective head identifier unit 46 with reference to the lookup table. More specifically, the identified maintenance-objective inkjet heads 2 are moved to flushing positions, in which the nozzle surfaces 2*a* thereof face the flushing area of the conveyer belt 53. Further, when the identified maintenance-objective inkjet heads 2 are moved to the flushing positions, the head controller 42 activates the actuator units 21 in the identified inkjet heads 2 to have inks ejected from the nozzles toward the flushing area. In this regard, inks are not ejected from the nozzles 108 in the non-identified inkjet heads 2, which are not specifically identified by the maintenance-objective head identifier unit 46. Thus, the maintenance operation to purge the inks out of the nozzles 108 of the identified inkjet heads 2 is completed.

According to the above-described maintenance operation, the inks in the nozzles 108, which could have been touched by the jammed sheet P, can be removed out of the nozzles 108. In other words, the possibly-touched nozzles 108 of the inkjet heads 2, which were facing the jammed sheet P, are cleared, and the menisci of the inks in the possibly-touched nozzles 108 are restored. In this regard, the inks in the nozzles 108, which are less likely to have been touched by the jammed sheet P, are prevented from being ejected. Therefore, an amount of the inks to be wasted in the maintenance operation can be effectively reduced.

According to the above-described inkjet printer 1, in which the inks in the nozzles 108 are ejected by activation of the actuator units 21, the condition of the inkjet heads 2 can be maintained more speedily and easily than an inkjet printer, which removes the remaining inks by, for example, a pump.

According to the above-described inkjet printer 1, when the signals output from the front-head sheet sensor 71*a* indicate ON, the inkjet heads 2, which vertically overlap the lengthwise range of the sheet P on the downstream side with respect to the position of the front-head sheet sensor 71*a* along the sheet-conveying direction, are identified. When the signals from the rear-head sheet sensor 71*b* or the at-exit sheet sensor 71*c* indicate ON, the inkjet heads 2, which vertically overlap the lengthwise range of the sheet P on an upstream side with respect to the rear-head sheet sensor 71*b* or the at-exit sheet sensor 70*c*, are identified. Therefore, the inkjet heads 2 with the nozzle surfaces 2*a*, which could have been touched by the jammed sheet P, can be easily identified.

Further, according to the above-described inkjet printer 1, if the output signals from the sheet sensors 71*a*, 71*b*, 71*c* do not turn OFF from ON within the predetermined first time period, which starts when the output signals from the sheet sensors 71*a*, 71*b*, 71*c* turn ON from OFF, or if the output signals from the sheet sensors 71*b*, 71*c* do not turn OFF from ON within the predetermined second time period, which starts when the output signals from the sheet sensors 71*a*, 71*b* turn ON from OFF, it is determined that the sheet P is jammed in a position along the sheet conveyer path. In this way, the sheet jam can be easily recognized based on the timings, at which presence of the sheet P is detected by the sheet sensors 71*a*, 71*b*, 71*c*.

Furthermore, according to the above-described inkjet printer 1, the maintenance-objective head identifier unit 46 stores the information concerning the identified maintenance-objective inkjet heads 2 in the nonvolatile memory, which can maintain the information even when power to the inkjet printer 1 is shut off. Therefore, even when the inkjet printer 1 is powered off due to error caused by the sheet jam, when the inkjet printer 1 is powered back on after the error is cleared, the information concerning the identified maintenance-objective inkjet heads 2 are saved.

Moreover, according to the above-described inkjet printer 1, the maintenance operation may not necessarily be conducted each time the inkjet printer 1 recovers from the sheet jam but may be selectively conducted according to the user's preference. Therefore, amounts of the inks to be consumed in the maintenance operations can be reduced even more effectively.

Variation of the Embodiment

If regaining the ink ejecting ability of the nozzles 108 has priority over reduction of the amounts of inks consumed in the maintenance operation, it may be preferable that the inks are ejected from the nozzles of all the inkjet heads 2 including the non-identified inkjet heads 2 regardless of the experience of being touched by the jammed sheet P. Therefore, the inkjet printer 1 may conduct the maintenance operation to all of the inkjet head 2. In this regard, the maintenance controller 47 may control a quantity of droplets of the inks to be ejected from the nozzles 108 of the non-identified inkjet head 2 to be smaller than a quantity of droplets of the inks to be ejected from the nozzles 108 of the maintenance-objective inkjet heads 2. Accordingly, the ink ejecting ability of nozzles 108 in all the inkjet heads 2 can be regained whilst the amounts of the inks to be wasted in the maintenance operation can be maintained to be smaller than the conventional maintenance operation, in which the inks are ejected from the nozzles of all the inkjet heads evenly.

Second Embodiment

Figure 8:
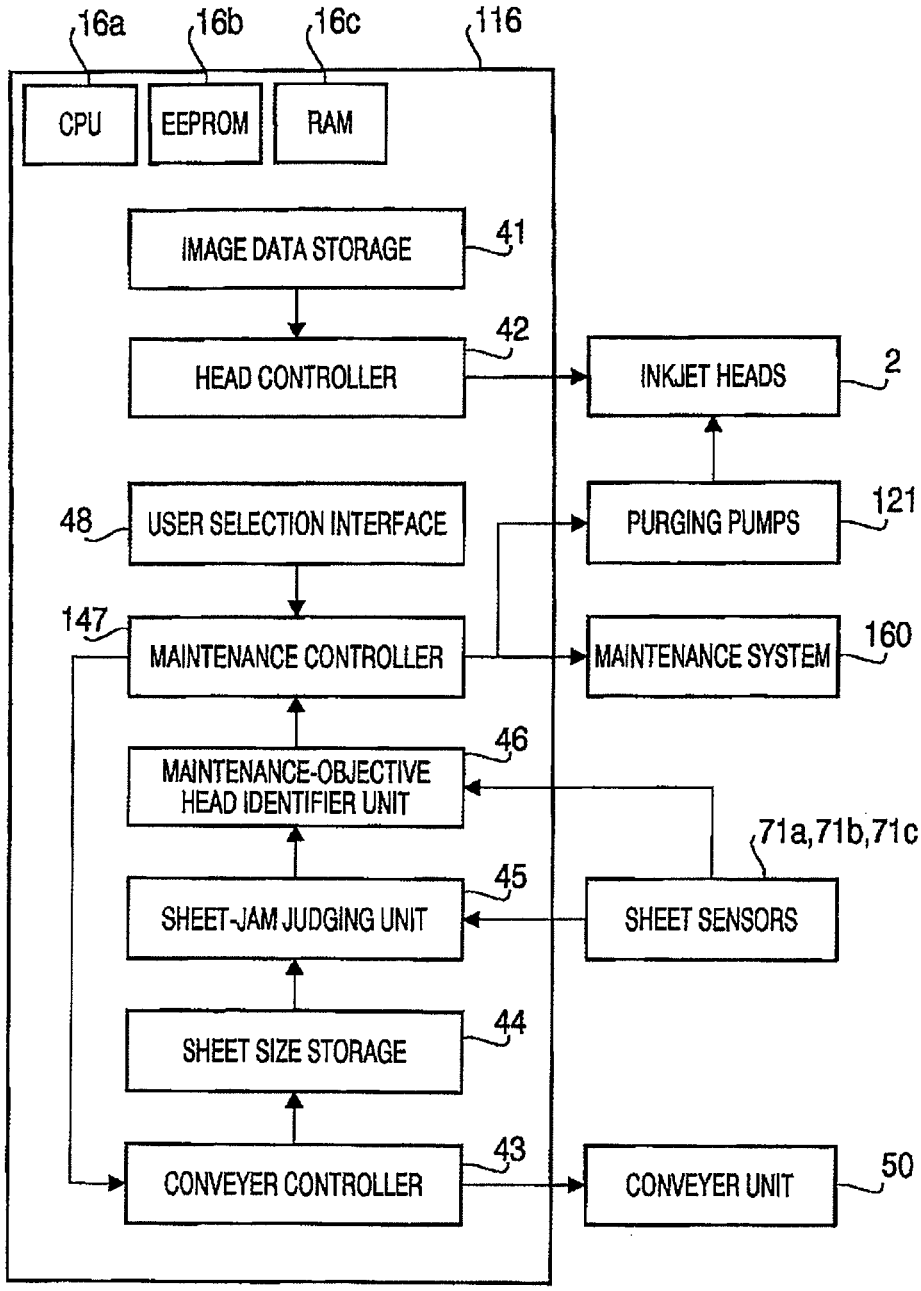
FIG. 8 is a block diagram to illustrate function blocks in a controller unit in the inkjet printer according to a second embodiment of the present invention.

A second embodiment of the present invention will be described hereinbelow with reference to FIG. 8. In the following description, components similar to those in the inkjet printer 1 in the first embodiment will be referred to by the same reference signs, and description of those will be omitted. An inkjet printer 101 according to the second embodiment is provided with four purge pumps 121, each of which is provided for one of the four inkjet heads 2. Each of the purge pumps 121 is arranged in midst of an ink channel, which connects an ink reservoir (not shown) and the ink supply holes 105*b* in the inkjet heads 2. When the purge pump 121 is activated, the ink is forcibly supplied from the ink reservoir to the ink supply holes 105. Further, the ink is forwarded to the branched ink channels via the subsidiary manifold channels 105*a* and ejected forcibly from the nozzles 108.

The inkjet printer 116 is further provided with a maintenance system 160. The maintenance system includes waste ink trays (not shown), which receive the inks ejected from the nozzles 108, and wipers (not shown), which wipe the nozzle surfaces 2*a* of the inkjet heads 2. The waste ink trays are movable between purging positions, in which the waste ink trays face the nozzle surfaces 2*a* of the inkjet heads 2, and standby positions, in which the waste ink trays do not face the nozzle surfaces 2*a*.

The controller unit 116 includes the image data storage 41, the head controller 42, the conveyer controller 43, the sheet-size storage 44, the sheet-jam judging unit 45, the maintenance-objective head identifier unit 46, a maintenance controller 147, and the user selection interface unit 48. The maintenance controller 47 starts a maintenance operation when the user's selection for the maintenance operation is entered through the user selection interface unit 48. When the maintenance operation starts, the maintenance controller 147 manipulates the maintenance system 160 to move the waste ink trays from the standby positions to the purging positions. Further, the maintenance controller 147 activates the purge pumps 121, which are arranged in the ink channels in the maintenance-objective inkjet heads 2 identified by the maintenance-objective head identifying unit 46, amongst the four purge pumps 121. Thus, the inks are ejected from the nozzles 108 of the identified maintenance objective inkjet heads 2 whilst ejecting the inks out of the nozzles 108 in the non-identified inkjet heads 2 is omitted. After completion of ejection of the inks from the nozzles 108, the maintenance controller 147 manipulates the maintenance system 160 to have the nozzle surfaces 2*a* wiped by the wipers. Thereafter, the waste ink trays are moved back to the standby positions. Thus, the maintenance operation to purge the inks out of the nozzles 108 is completed.

According to the inkjet printer 101 described above, the inks in the nozzles 108, which could have been touched by the jammed sheet P, can be ejected out of the nozzles 108. In this regard, the inks in the nozzles 108, which are less likely to have been touched by the jammed sheet P, are prevented from being ejected. Therefore, the ability to eject the inks from the nozzles 108 can be regained whilst an amount of the inks to be wasted in the maintenance operation can be effectively reduced.

Variation of the Embodiment

If regaining the ink ejecting ability of the nozzles 108 has priority over reduction of the amounts of inks consumed in the maintenance operation, it may be preferable that the inks are ejected out of the nozzles of all the inkjet heads 2 including the non-identified inkjet heads 2 regardless of the experience of being touched by the sheet P. Therefore, the maintenance controller 47 may optionally control amounts of the inks to be ejected out of the nozzles 108 of the non-identified inkjet head 2 to be smaller than amounts of the inks to be ejected out of the nozzles 108 of the maintenance-objective inkjet heads 2. Accordingly, the ink ejecting ability of nozzles 108 in all the inkjet heads 2 can be regained whilst the amounts of the inks to be wasted in the maintenance operation can be maintained to be smaller than the conventional maintenance operation, in which the inks are ejected out of the nozzles of all the inkjet heads evenly. The amounts of the inks to be ejected out of the nozzles 108 may be adjusted by controlling length of time period, in which the purge pumps 121 are activated, and/or purging capacity of the purge pumps 121 per unit of time. Alternatively, in the non-identified inkjet heads 2, the actuator units 21 may be activated in order to eject droplets of the inks from the nozzles 108 in place of activating the purge pumps 121 and purging the inks from the nozzles 108. In this regard, the amounts of the inks ejected in droplets from the nozzles 108 may be set to be smaller than the amounts of inks to be ejected by the purge pumps 121.

Although examples of carrying out the invention have been described, those skilled in the art will appreciate that there are numerous variations and permutations of the liquid ejecting device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above-described embodiments, the sheet sensors 71*a*, 71*b*, 71*c* are arranged in the position on the upstream side with respect to the four inkjet heads 2, on the downstream side with respect to the four inkjet heads 2, and on the further downstream side with respect to the sheet sensor 71*b* along the sheet-conveying direction, respectively. However, the sheet sensors may not necessarily be arranged in those positions but may be arranged in any positions within a range, in which the sheet sensors can detect the sheet P facing the inkjet heads 2. Further, the quantity of the sheet sensors may not necessarily be three but may be one, two, four, or more. In order to accurately identify the maintenance-objective inkjet heads 2, however, it is preferable that the sheet sensors are arranged on each side of the inkjet heads 2 along the sheet-conveying direction.

Moreover, the sheet sensors may not necessarily be used exclusively to identify the maintenance-objective inkjet heads 2 but may be used to detect the sheet P in other purpose. For example, if the inkjet printer is capable of reversing the sheet P to form an image on the reversed side of the sheet P, the inkjet printer may be equipped with a branched sheet conveyer path, through which the sheet P can be reversed upside-down. In this regard, one of the sheet sensors may detect the rear end of the sheet P passing through the branched path to determine that the sheet P has been reversed.

Furthermore, the maintenance-objective inkjet heads 2 may not necessarily be identified with reference to the lookup table, in which the combinations of the output signals from the sheet sensors 71*a*-71*c* and the possibly-touched inkjet heads 2 overlapping the sheet P are associated. For example, the maintenance-objective inkjet heads 2 may be identified by calculating the range, in which the sheet P can be included, based on the sheet size and the combination of the output signals from the sheet sensors 71*a*-71*c* and determining the inkjet heads 2 arranged in the positions within the calculated range.

In the above-described embodiments, if the output signals from the sheet sensors 71*a*, 71*b*, 71*c* do not turn OFF from ON within the predetermined first time period, which starts when the output signals from the sheet sensors 71*a*, 71*b*, 71*c* turn ON from OFF, or if the output signals from the sheet sensors 71*b*, 71*c* do not turn OFF from ON within the predetermined second time period, which starts when the output signals from the sheet sensors 71*a*, 71*b* turn ON from OFF, it is determined that the sheet P is jammed in a position along the sheet conveyer path. However, it may be determined that the sheet P is jammed solely when the output signals from the sheet sensors 71*a*, 71*b*, 71*c* do not turn OFF from ON within the predetermined first time period. Alternatively, it may be determined that the sheet P is jammed solely when the output signals from the sheet sensors 71*b*, 71*c* do not turn OFF from ON within the predetermined second time period.

For another example, the information concerning the identified inkjet heads 2 may not necessarily be stored in the nonvolatile memory but may be stored in a volatile memory (e.g., in a work area in the RAM 16*c*).

For another example, the maintenance operation may not necessarily be conducted optionally according to the user's preference but may be forcibly or automatically conducted regardless of the user's preference.

Furthermore, the unimorph-typed piezoelectric actuators in the actuator units 21 in the above-described embodiments may be replaced with bimorph-typed piezoelectric actuators. Alternatively, the inkjet heads 1 may be a thermally ink ejecting device with a heating element, which is configured to eject the inks by heat. In other words, the actuators may not necessarily elements to convert electricity into deformable force.

The above-described embodiment may be applied to a recording apparatus, which ejects liquid other than ink. Further, the above-described embodiments may not necessarily be applied to a printer but may be applied to other image recording apparatus such as a facsimile machine or a copier.

What is claimed is:

1. A liquid ejecting device, which is configured to eject droplets of liquid onto a surface of a recording medium to record an image, comprising:

a conveyer, which is configured to convey the recording medium in a conveyer path along a conveying direction;

a plurality of liquid ejecting heads, each of which includes a plurality of nozzles configured to eject the droplets of liquid onto the surface of the recording medium being conveyed by the conveyer;

a liquid purging unit, which is configured to purge the liquid out of the nozzles of the plurality of liquid ejecting heads;

a detector unit, which is arranged in at least one predetermined position along the conveyer path and configured to detect presence of the recording medium in the conveyer path;

a storage unit, which is configured to store information concerning the length of the recording medium being conveyed along the conveying direction;

a judging unit, which is configured to judge whether the recording medium being conveyed is jammed in the conveyer path based on timing when the presence of the recording medium is detected by the detector unit;

a head identifier unit, which is configured to identify an overlapping liquid ejecting head assumedly facing the recording medium jammed in the conveyer path amongst the plurality of liquid ejecting heads, when the judging unit determines that the recording medium is jammed in the conveyer path, based on the detected result obtained by the detector unit and the information concerning the length of the recording medium stored in the storage unit; and a purge controller unit, which is configured to manipulate the liquid purging unit to control an amount of the liquid to be purged from the nozzles in the remaining liquid ejecting heads other than the overlapping liquid ejecting head identified by the head identifier unit to be smaller than an amount of the liquid to be purged from the nozzles in the overlapping liquid ejecting head identified by the head identifier unit.

2. The liquid ejecting device according to claim 1, wherein each of the liquid ejecting heads is provided with a plurality of branched liquid channels, which are in fluid communication with the plurality of nozzles via pressure chambers;

wherein the liquid purging unit includes a plurality of actuators, which are configured to apply ejecting force to the liquid in the pressure chambers to have the liquid ejected from the nozzles;

wherein the purge controller unit controls the plurality of actuators, when a quantity of the overlapping liquid ejecting head is at least one and smaller than a total quantity of the plurality of liquid ejecting heads, to maintain a quantity of the droplets of liquid to be ejected from the nozzles of the remaining liquid ejecting heads to be smaller than a quantity of the droplets of liquid to be ejected from the nozzles of the overlapping liquid ejecting head.

3. The liquid ejecting device according to claim 1, wherein the purge controller unit controls the liquid purging unit to prevent the liquid from being ejected from the nozzles of the remaining liquid ejecting heads when a quantity of the overlapping liquid ejecting head is at least one and smaller than a total quantity of the plurality of liquid ejecting heads.

4. The liquid ejecting device according to claim 1, wherein at least a part of the detector unit is arranged in an upstream position with respect to the plurality of liquid ejecting heads along the conveyer path; and wherein, when the at least a part of the detector unit detects the presence of the recording medium and when the judging unit determines that the recording medium is jammed in the conveyer path, the head identifier unit identifies the liquid ejecting head being included in a lengthwise range of the recording medium on a downstream side with respect to the at least a part of the detector unit amongst the plurality of liquid ejecting heads.

5. The liquid ejecting device according to claim 1, wherein at least a part of the detector unit is arranged in a downstream position with respect to the plurality of liquid ejecting heads along the conveyer path; and wherein, when the at least a part of the detector unit detects the presence of the recording medium and when the judging unit determines that the recording medium is jammed in the conveyer path, the head identifier unit identifies the liquid ejecting head being included in a lengthwise range of the recording medium on an upstream side with respect to the at least a part of the detector unit amongst the plurality of liquid ejecting heads.

6. The liquid ejecting device according to claim 1, wherein the judging unit determines that the recording medium is jammed in the conveyer path when the detector unit fails to detect a lengthwise rear end of the recording medium after detecting a lengthwise front end of the recording medium within a predetermined time period.

7. The liquid ejecting device according to claim 1, wherein the detector unit includes at least two detector units, which are arranged in different positions from each other along the conveyer path; and wherein the judging unit determines that the recording medium is jammed in the conveyer path when, after one of detector units arranged on an upstream side along the conveying direction detects a lengthwise front end of the sheet, the other of the detector units arranged on a downstream side along the conveying direction fails to detect the lengthwise front end of the sheet within a predetermined time period.

8. The liquid ejecting device according to claim 1, wherein information concerning the identified overlapping liquid ejecting head is saved in a nonvolatile memory device.

9. The liquid ejecting device according to claim 1, further comprising:

a selection input unit, through which a user of the liquid ejecting device selectively enters one of at least two options of conducting and omitting the ejection of the liquid from the nozzles, wherein the purge controller unit manipulates the liquid purging unit to eject the liquid from the nozzles when the user selects conducting the ejection of the liquid from the nozzles.

* * * * *